US006007755A

United States Patent [19]

Hoshii et al.

[11] Patent Number: 6,007,755

[45] Date of Patent: Dec. 28, 1999

[54] RESISTOR TRIMMING METHOD

[75] Inventors: Mitsuhiro Hoshii; Koji Sato, both of Komatsu, Japan

[73] Assignee: Murata Manufacturing Co., Ltd., Nagaokakyo, Japan

[21] Appl. No.: 08/927,083

[22] Filed: Sep. 10, 1997

Related U.S. Application Data

[62] Division of application No. 08/604,016, Feb. 20, 1996.

[30] Foreign Application Priority Data

Feb. 21, 1995 [JP] Japan ..... 7-032523

[51] Int. Cl.[6] ..... H01C 10/00

[52] U.S. Cl. ..... 264/400; 219/121.68; 219/121.69; 264/482; 338/195

[58] Field of Search ..... 264/400, 482; 338/195; 29/620; 219/121.68, 121.69

[56] References Cited

U.S. PATENT DOCUMENTS 4,284,970 8/1981 Berrin et al. ..... 338/195
4,647,899 3/1987 Moy ..... 338/195
5,043,694 8/1991 Higashi et al. ..... 338/195
5,198,794 3/1993 Sato et al. ..... 338/195
5,754,092 5/1998 Ishida et al. ..... 338/195

*Primary Examiner*—Mathieu D. Vargot
*Attorney, Agent, or Firm*—Burns, Doane, Swecker & Mathis, LLP

[57] ABSTRACT

A resistor trimming method which brings about a good surge resistance and which allows a quick and reliable trimming, including the steps of forming a first slit 141 from an edge A of a resistor 11 formed between a pair of electrodes 12*a* and 12*b* provided on an insulating substrate 13, the first slit being in the proximity of and in parallel to one electrode 12*a*, forming a second slit 142 as a continuation of the first slit 141 toward the other one of the electrodes 12*b*, the second slit 142 being perpendicular to the first slit 141, and forming at least one approximately L-shaped slit 143 as a continuation of either one of the first slit 141 or the second slit 142.

4 Claims, 3 Drawing Sheets

RESISTOR TRIMMING METHOD

This application is a divisional of application Ser. No. 08/604,016, filed Feb. 20, 1996.

BACKGROUND OF THE INVENTION

1. Field of the Invention

The present invention relates to a method for trimming a printed resistor and, more particularly, to a method for trimming a printed resistor formed on an insulating substrate in a hybrid integrated circuit (IC).

2. Description of the Related Art

FIGS. 4 through 9 show plan views of conventional printed resistors having various kinds of slit patterns. In each of these figures, a resistor 1 is formed extending over a pair of electrodes 2*a* and 2*b* provided on an insulating substrate 3 by means of screen printing or the like. Slits 41 through 46 are formed in the resistors 1 by trimming to adjust the resistance value of the resistor 1.

Among the slits 41 through 46 formed by trimming to adjust the resistance, the slit 41 shown in FIG. 4 is formed by trimming so as to extend from one edge of the resistor 1 in parallel with the electrode 2*a* and to be bent perpendicularly approximately in the shape of L.

The slit 42 shown in FIG. 5 is formed by trimming as a continuation of the slit 41 trimmed approximately in the shape of L so that the new slit returns toward one edge of the resistor 1 approximately in the shape of a square bottomed J.

The slit 43 shown in FIG. 6 is formed by trimming in the shape of J starting from one edge of the resistor 1.

The slit 44 shown in FIG. 7 is formed by scan-cutting off a portion of the resistor 1 from one edge of the resistor 1 between the electrodes 2*a* and 2*b*.

Further, the slit 45 shown in FIG. 8 is formed by trimming in the shape of U the tops of which extend from one edge of the resistor 1, the width of the U extending from the electrode 2*a* side to the electrode 2*b* side.

The slit 46 shown in FIG. 9 is formed by trimming (lean cutting) one end of the resistor 1 linearly between the electrode 2*a* and the electrode 2*b* while also cutting parts of the electrodes 2*a* and 2*b*.

The conventional trimming methods described above have had the following problems.

First, resistors having the L-shaped slit 41, the square bottomed J-shaped slit 42 and the J-shaped slit 43 as shown in FIGS. 4 through 6 are susceptible to changes in resistance value due to a surge. More specifically, as shown in FIG. 10(*a*), a current density is distributed non-uniformly in the printed resistor 1 having a L-shaped slit 41, so that a current is concentrated at points D and E which are located near the bending portion and an end portion of the L-shaped slit 41. As a result, microcracks occur at points D and E or the resistor burns at points D and E when the resistor is subjected to a surge. This causes the change of resistance of the resistor. For example, the resistance of these resistors shown in FIGS. 4 through 6 change with 3.350% on average before and after a surge in a lightning surge test.

Second, although the method of forming the slit 44 by scan-cut as shown in FIG. 7 brought about a good surge resistance and it can be described as an effective trimming method, it takes a considerable amount of time for the trimming, thus raising the cost of the product.

Third, while the method of forming the slit 45 by trimming approximately in the U-shape as shown in FIG. 8 is is done quickly while maintaining the surge resistance of the scan-cut shown in FIG. 8, there is a possibility that it turns out to be a J-shaped slit (similar to one shown in FIG. 6) as the trimming is terminated during the trimming of the U-shape due to a dispersion of an initial value of the resistor. As a result, there is a possibility that this resistor will suffer from the aforementioned problem.

Fourth, in the method of forming the slit 46 by a lean-cut shown in FIG. 9 (trimming the resistor 1 and the electrodes 2*a* and 2*b*), the trimming is quickly done while maintaining the surge resistance similar to the method of forming the slit 45 by trimming in the U-shape. However, it has been very difficult to program the necessary trimming machinery to completely cut both electrodes. The resistor and occasionally the electrodes have not been completely cut, resulting in a parallel electrical connection of the resistor and thus the method lacks reliability.

Accordingly, it is an object of the present invention to solve the aforementioned problems by providing a resistor trimming method which brings about a good surge resistance and which allows a slit to be formed in the resistor quickly and reliably. It is another object of the present invention to provide a resistor having a slit formed by the resistor trimming method of the present invention.

SUMMARY OF THE INVENTION

In order to achieve the aforementioned objects, according to one aspect of the present invention, a resistor trimming method comprises steps of forming a first slit from an edge of a resistor interconnecting a pair of electrodes provided on an insulating substrate in the proximity of and parallel to one of the electrodes; forming a second slit as a continuation of the first slit toward the other one of the electrodes perpendicularly to the first slit; and forming at least one approximately L-shaped slit continuously from either one of the first slit or second slit.

In one embodiment of the invention, the L-shaped slit is formed continuously from the first slit.

In another embodiment of the invention, the L-shaped slit is formed continuously from the second slit.

According to another aspect of the present invention, a resistor trimming method comprises the steps of forming a first slit from an edge of a resistor formed between a pair of electrodes provided on an insulating substrate in the proximity of and parallel to one of the electrodes; forming a second slit as a continuation from the first slit toward the other one of the electrodes perpendicularly to the first slit; forming at least one approximately L-shaped slit as a continuation from the first slit; forming a third slit from an edge of the resistor in the proximity of and in parallel to the other one of the electrodes; forming a fourth slit as a continuation of the third slit toward the other one of the electrodes perpendicularly to the third slit while disposed between the second slit and the L-shaped slit; and forming at least one approximately reversely oriented L-shaped slit as a continuation of the third slit alternately with the L-shaped slit.

According to still another aspect of the invention, a resistor made from a resistance material by a printing method and formed between a pair of electrodes is provided. In the resistor, a first L-shaped slit having first and second ends is provided, the first end of the first L-shaped slit is provided on a side of the resistor which crosses between the pair of electrodes, and the first and second ends are located within about 0.3 mm from the pair of electrodes, respectively.

According to the invention, a rate of change of resistance before and after a surge in a lightning surge test becomes as small as 0.003% on average and a resistor having a good surge resistance can be formed quickly and reliably by trimming the slits provided on the resistor from the position in the close proximity of the electrodes.

The above and other related objects and features of the present invention will be apparent from a reading of the following description of the disclosure found in the accompanying drawings and the novelty thereof pointed out in the appended claims.

BRIEF DESCRIPTION OF THE DRAWINGS

FIG. 10(*b*) shows a distribution of a current density in a resistor of the present invention shown in FIG. 1.

DETAILED DESCRIPTION OF PREFERRED EMBODIMENT

Example 1

A resistor and a resistor trimming method according to one preferred embodiment of the present invention will be explained below with reference to FIG. 1.

Figure 1:
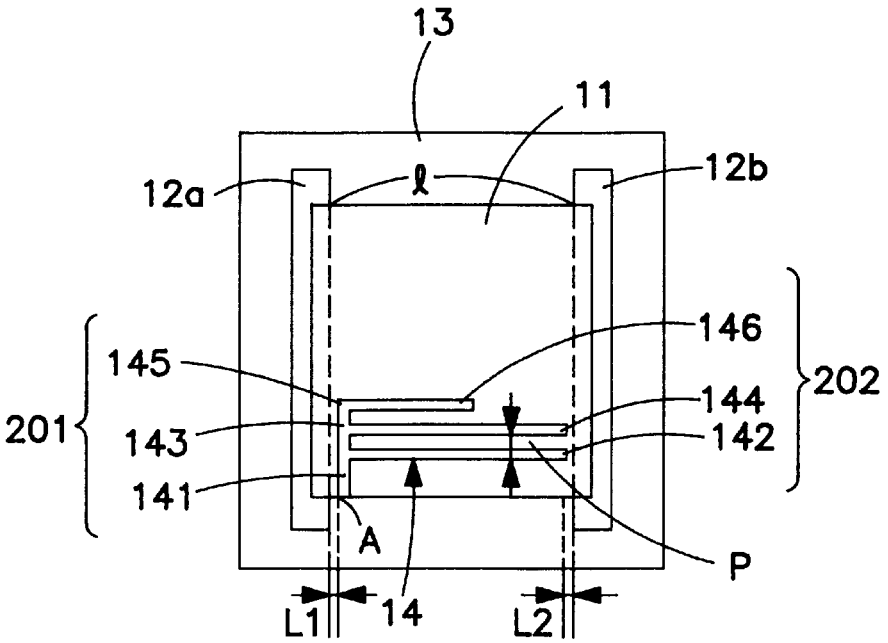
FIG. 1 is a plan view of electrodes and a resistor illustrating one embodiment of the present invention.

As shown in FIG. 1, a resistor (printed resistor) 11 is formed so as to extend over a pair of electrodes 12*a* and 12*b* provided facing to a insulating substrate 13 by means of screen printing or the like. The resistor 11 can be made from any kind of known resistance materials. The resistor 11 can be incorporated in a hybrid integrated circuit (IC) or manufactured as a discrete component.

A comb-like slit 14 is provided in the resistor 11. The comb-like slit 14 includes a vertical slit 201 and a plurality of horizontal slits 202 extending from the vertical slit 201. The vertical slit 201 is formed in the resistor 11 near and in parallel to a first of the electrodes 12*a* and extends from one side toward the opposite side of the resistor 11. The horizontal slits 202 are formed in the resistor 11 along a direction substantially perpendicular to the vertical slit 201. It is preferable that a start point of the vertical slit 201 and end point of at least one horizontal slit 202 are respectively as close to the electrodes 12*a* and 12*b* as possible, and is more preferable that the distance L1 between the first electrode 12*a* and the start point of the vertical slit 201 and the distance L2 between the second electrode 12*b* and the end point of the horizontal slit 202 are within about 0.3 mm. Although FIG. 1 shows three horizontal slits 202, the number of the horizontal slits 203 is determined based on the degree of adjusting of resistance. Also, distance P between the horizontal slits 202 is determined based on how precisely the resistance of the resistor should be adjusted.

The resistance of the resistor 11 is adjusted by forming the comb-like slit 14 using a laser beam such as a YAG laser or the like while the resistance value of the resistor 11 is measured.

Specifically, a first slit 141 is formed in the resistor 11 by trimming from an edge A of the resistor 11 in the proximity of the first electrode 12*a* along direction substantially parallel to the second electrode 12*a*. As is explained above, the edge A is preferably located within 0.3 mm from the electrode 12*a*. Then, a second slit 142 is formed approximately in the shape of L as a combination of the first slit 141 by trimming continuously from the end of the first slit 141 along a direction perpendicular to the first slit 141.

Further, third and fourth slits 143 and 144 are formed approximately in the shape of L by trimming continuously in the directions along the first slit 141 and second slit 142 in the same manner as the first and second slits 141 and 142 from the point of intersection of the first and second slits 141 and 142. Fifth and sixth slits 145 and 146 and so on are also formed in the same manner.

During the formation of the these slits, if the resistance of the resistor 11 increases to a targeted value, adjusting the resistance is thus finished.

Example 2

Figure 2:
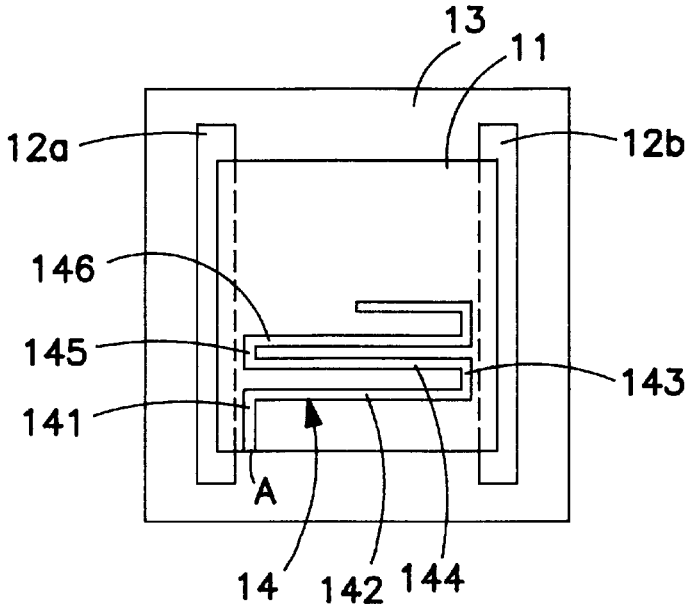
FIG. 2 is a plan view of electrodes and a resistor illustrating another embodiment of the present invention.

In FIG. 2, the same or corresponding parts of the first embodiment shown in FIG. 1 are denoted by the same reference numerals for clarify. That is, the resistor 11 is formed so as to extend over the pair of electrodes 12*a* and 12*b* provided on the insulating substrate 13 by means of screen printing or the like.

A meandering slit 14 is provided in the resistor 11. The meandering slit 14 starts at point A provided on one edge of the resistor 11 which crosses between the electrodes 12*a* and 12*b* and meanders between the electrodes 12*a* and 12*b* with elongated portions in a direction perpendicular to the electrodes 12*a* and 12*b*. The point A is preferably proximate to one of the electrodes 12*a* or 12*b*, more preferably within 0.3 mm from the electrodes 12*a* or 12*b*. It is also preferable that the meandering slit 14 turns, i.e., changes the orientation of its elongated portions to be in close proximity of the electrodes 12*a* or 12*b*.

The resistance of the resistor 11 shown in FIG. 2 is adjusted by forming the meandering slit 14 using a laser beam such as a YAG laser or the like while the resistance value of the resistor 11 is measured.

Specifically, a first slit 141 is formed by trimming from an edge point A of the resistor 11 in the proximity of the first electrode 12*a* along a direction (width direction of the resistor 11) parallel with the first electrode 12*a*.

A second slit 142 is formed approximately in the shape of L in combination with the first slit 141 by trimming continuously from the first slit 141 in the direction toward the second electrode 12*b* to a position in the proximity of the second electrode 12*b* along a direction (axial direction of the resistor 11) perpendicular to the first slit 141.

A third slit 143 is formed by trimming continuously from the second slit 142 along the width direction of the resistor 11 in parallel with the second electrode 12*b*, and a fourth slit 144 is formed approximately in the shape of L in combination with the third slit 143 by trimming continuously from the third slit 143 to approximately the middle of the resistor 11 in the width direction toward the first electrode 12*a* along the axial direction of the resistor 11 perpendicular to the third slit 143 to a position in the proximity of the first electrode 12*a*.

Fifth and sixth slits 145 and 146 are further formed by trimming in the same manner continuously from the fourth slit 144 and by forming slits by trimming one by one until a targeted resistance value is obtained.

Example 3

Figure 3:
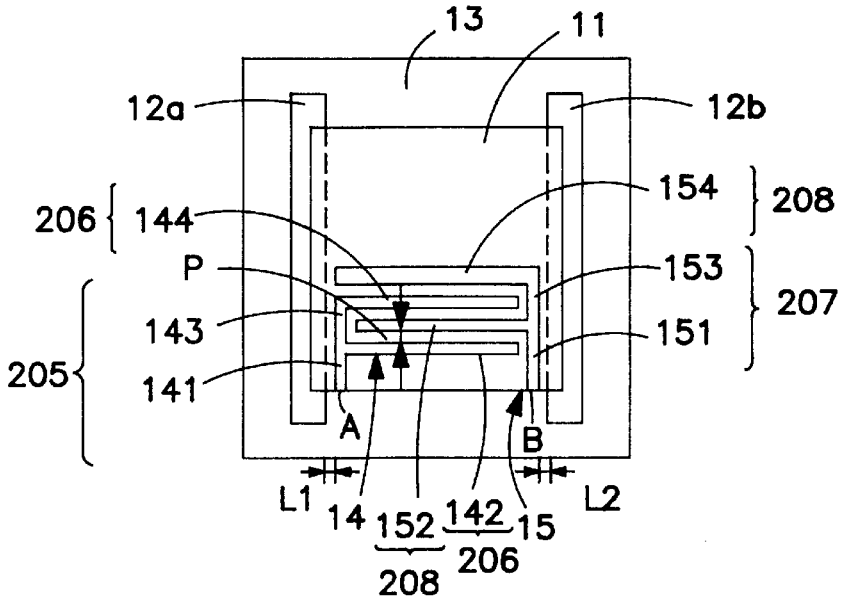
FIG. 3 is a plan view of electrodes and a resistor illustrating still another embodiment of the present invention.
Figure 4:
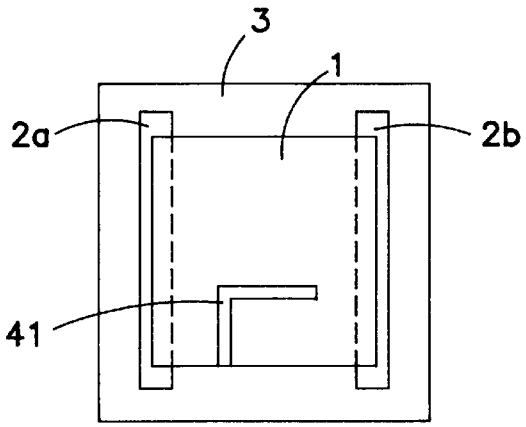
FIG. 4 PRIOR ART
FIG. 4 is a plan view of electrodes and a resistor illustrating an example of prior art.
Figure 5:
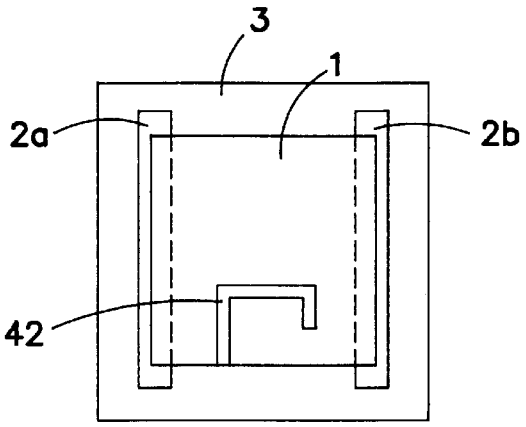
FIG. 5 PRIOR ART
FIG. 5 is a plan view of electrodes and a resistor illustrating another example of prior art.
Figure 6:
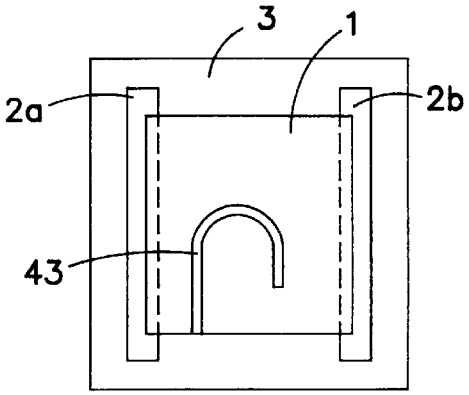
FIG. 6 PRIOR ART
FIG. 6 is a plan view of electrodes and a resistor illustrating still another example of prior art.
Figure 7:
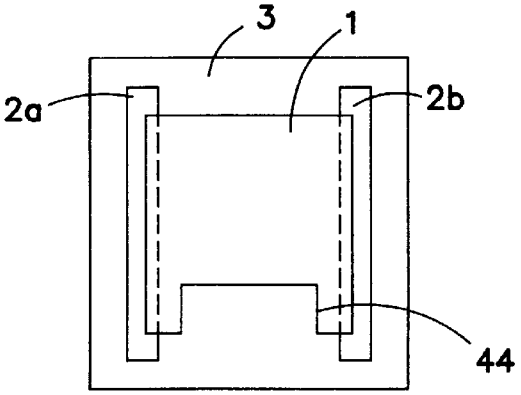
FIG. 7 PRIOR ART
FIG. 7 is a plan view of electrodes and a resistor illustrating still another example of prior art.
Figure 8:
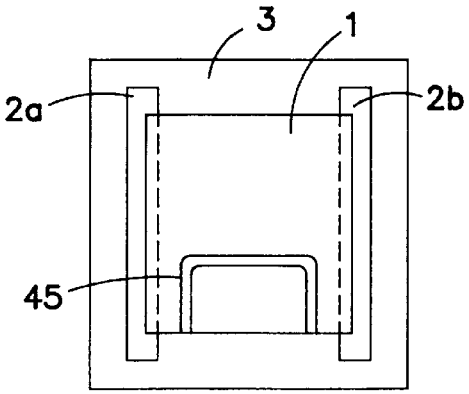
FIG. 8 PRIOR ART
FIG. 8 is a plan view of electrodes and a resistor illustrating still another example of prior art.
Figure 9:
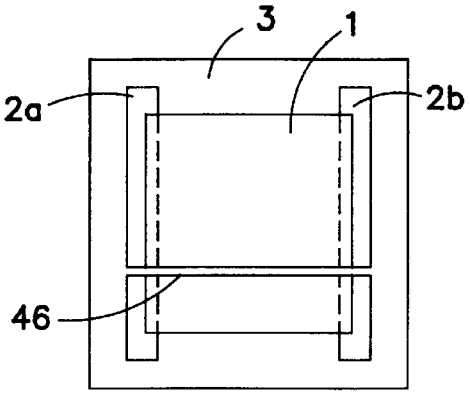
FIG. 9 PRIOR ART
FIG. 9 is a plan view of electrodes and a resistor illustrating still another example of prior art.

In FIG. 3, the same or corresponding parts of the first embodiment shown in FIG. 1 are denoted by the same reference numerals for clarity. That is, the resistor 11 is formed so as to extend over the pair of electrodes 12*a* and 12*b* provided on the insulating substrate 13 by means of screen printing or the like.

In this example, a first comb-like silt 14 and a second comb-like slit 15 are formed in the resistor 11 so that the first comb-like slit 14 and the second comb-like slit 15 are interwoven with each other.

The first comb-like slit 14 includes a first vertical slit 205 and a plurality of horizontal slits 206 extending from the vertical slit 205. The first vertical slit 205 is formed in the resistor 11 along the first electrode 12*a* and extends from one side toward the opposite side of the resistor 11. Horizontal slits 206 are formed in the resistor 11 along a direction substantially perpendicular to the vertical slit 205.

The second comb-like slit 15 includes a second vertical slit 207 and a plurality of horizontal slits 208 extending from the second vertical slit 207. The second vertical slit 207 is formed in the resistor 11 along the electrodes 12*a* and extend form one side to the opposite side of the resistor 11. Horizontal slits 208 are formed in the resistor 11 along a direction substantially perpendicular to the second vertical slit 207.

It is preferable that start points A and B of the first vertical slit 205 and the second vertical slit 207 are as close as possible to the respective first and second electrodes 12*a* and 12*b*, and it is more preferable that the distance L1 between the first electrode 12*a* and the start point of the first comb-like slit 14, and the distance L2 between the second electrode 12*b* and the start point of the second comb-like slit are within about 0.3 mm.

Although FIG. 3 shows two horizontal slits 206 and two horizontal slit 208, the number of the horizontal slits 206 and 208 being determined based on the degree of adjusting of resistance. Also, distance P between the horizontal slits 206 and 208 is determined based on how precisely the resistance of the resistor should be adjusted.

The resistance of the resistor 11 is adjusted by forming the comb-like slits 14 and 15 using a laser beam such as from a YAG laser or the like while the resistance value of the resistor 11 is measured.

Specifically, a first slit 141 is formed by trimming from the edge point A of the resistor 11 in the proximity of the first electrode 12*a* along a direction (width direction of the resistor 11) parallel with the first electrode 12*a* and a second slit 142 is formed approximately in the shape of L in combination with the first slit 141 by trimming continuously from the first slit 141 approximately in the width direction toward the second electrode 12*b* to a position in the proximity of the second electrode 12*b* along the axial direction of the resistor 11 perpendicularly to the first slit 141.

A third slit 151 is formed by trimming from an edge point B of the resistor 11 in the proximity of the second electrode 12*b* along the width direction of the resistor 11 in parallel with the second electrode 12*b* and a fourth slit 152 is formed approximately in the shape of L in combination with the third slit 151 by trimming continuously from the third slit 151 approximately in the width direction toward the first electrode 12*a* to a position in the proximity of the second electrode 12*b* along the axial direction of the resistor 11 perpendicularly to the third slit 151.

Further, fifth and sixth slits 143 and 144 are formed in the same manner with the first and second slits 141 and 142 by trimming continuously in the width and axial directions of the resistor 11 from the point of intersection of the first and second slits 141 and 142 and seventh and eighth slits 153 and 154 are formed in the same manner by trimming from the point of intersection of the third and fourth slits 151 and 152. Thereafter, the L-shaped slit 14 and the reversed-L-shaped slit 15 are alternately formed by trimming slits one by one until a targeted resistance value is obtained.

Figure 10A:
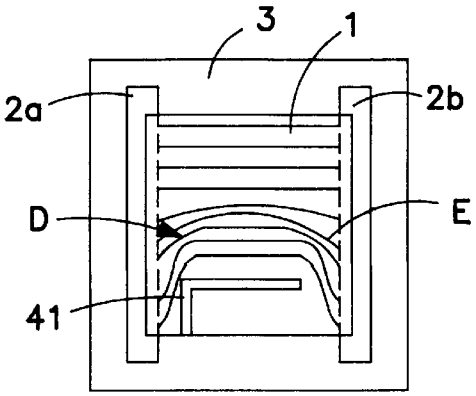
FIG. 10(*a*) shows a distribution of a current density in a resistor having a L-shaped according to an example of prior art.
Figure 10B:
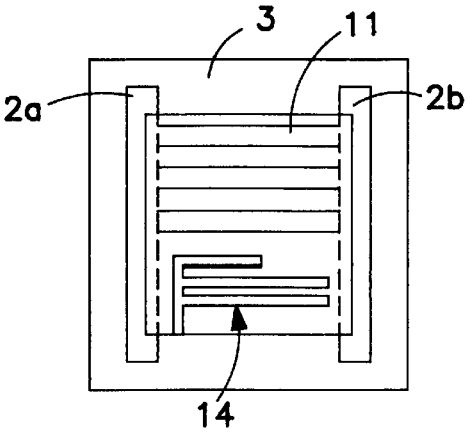

Hereinafter, effects of the present invention will be explained. FIG. 10(*b*) schematically shows a distribution of a current density in the resistor 11 shown in FIG. 1. As is understood from FIG. 10(*b*), the current density in the resistor 11 distributes uniformly in the resistor. This is because the resistor of the invention has at least one L-shape slit which starts from a point close to one of the electrodes and has an elongated horizontal part so as to have about the same length as the distance between the electrodes 12*a* and 12*b*.

Table 1 shows a rate of change of resistance before and after a surge in a lightning surge test. Each of samples used for the test has an area of 50 $mm^2$ and is subjected to ten times of the current flow of 96 A for 8/20 $\mu$s. Data shown in Table 1 is the average value obtained from ten samples for each example.

TABLE 1

| | Resistance before surge test (Ω) | | Resistance after surge test (Ω) | | Change rate of resistance (%) | |
|---|---|---|---|---|---|---|
| Sample | Ave. | 3σ | Ave. | 3σ | Ave. | 3σ |
| Example 1 | 49.584 | 0.051 | 49.633 | 0.330 | −0.003 | 0.008 |
| Example 3 | 49.606 | 0.094 | 49.604 | 0.094 | −0.003 | 0.016 |
| Comp. Ex. | 49.538 | 0.133 | 51.197 | 1.277 | 3.350 | 2.602 |

As is apparent from Table 1, a change rate of resistance before and after a surge in a lightning surge test became as small as 0.003% on average and a good surge resistance, which is almost in the same level (not shown in Table 1) as the scan-cut, could be obtained by trimming the slit according to the present invention.

In addition, the present invention provides the resistor trimming method which can be quickly done as compared to the prior art scan-cut.

Furthermore, the present invention provides the resistor trimming method which can realize steady and reliable trimming as compared to the U-shaped trimming or the lean cut.

As is explained above, it is noted that it is desirable to bring the distance between the first electrode 12*a* and the edge point A and the distance between the second electrode 12*b* and the edge point B as close to zero as possible in order to provide a good surge resistance to the resistor 11. Further, it is preferable to arrange the slit extending in one direction so as to extend to a position close the opposite electrode, i.e., so as to have about a same length with a length of the resistor 11.

It is also noted that while the first slit has had approximately the shape of an L in the embodiments described above, it may have the shape of a U or a J.

While preferred embodiments have been described, variations thereto will occur to those skilled in the art within the scope of the present inventive concepts which are delineated by the following claims.

What is claimed:

1. A resistor trimming method, comprising steps of:

forming a first slit from an edge of a resistor formed between a pair of electrodes provided on an insulating substrate, said first slit being in the proximity of and in parallel to one of said electrodes;

forming a second slit as a continuation of said first slit toward to the other one of said electrodes and perpendicular to said first slit; and forming at least one approximately L-shaped slit from an end of either one of said first slit or said second slit as a continuation of said first slit or said second slit.

2. The resistor trimming method according to claim 1, wherein said L-shaped slit is formed as a continuation of said first slit.

3. The resistor trimming method according to claim 1, wherein said L-shaped slit is formed as a continuation of said second slit.

4. A resistor trimming method, comprising steps of:

forming a first slit from an edge of a resistor formed between a pair of electrodes provided on an insulating substrate, said first slit being in the proximity of and parallel to a first one of said electrodes;

forming a second slit as a continuation of said first slit toward a second one of said electrodes and perpendicular to said first slit;

forming a third slit from an edge of said resistor in the proximity of and in parallel to the second of said electrodes;

forming a fourth slit as a continuation of said third slit toward the first one of said electrodes and perpendicular to said third slit;

forming at least one approximately L-shaped additional slit as a continuation of said first slit; and forming at least one approximately L-shaped further slit as a continuation of said third slit, said at least one additional slit and said at least one further slit alternate spatially with one another.

* * * * *